US005546718A

United States Patent [19]

Way

[11] Patent Number: 5,546,718

[45] Date of Patent: Aug. 20, 1996

[54] PARTITION WALL

[75] Inventor: Hsiao Way, Taipei, Taiwan

[73] Assignee: Chingdar Enterprise Co., Ltd., Taipei, Taiwan

[21] Appl. No.: 442,827

[22] Filed: May 17, 1995

[51] Int. Cl.[6] ..... E04H 5/00

[52] U.S. Cl. ..... 52/238.1; 52/239; 160/135/351

[58] Field of Search ..... 52/238.1, 239, 52/656.1; 160/135, 351

[56] References Cited

U.S. PATENT DOCUMENTS

| | | | |
|---|---|---|---|
| 5,069,263 | 12/1991 | Edwards | 160/135 |
| 5,125,201 | 1/1992 | Pieter et al. | 52/238.1 |
| 5,187,912 | 2/1993 | Hsueh | 52/238.1 X |
| 5,313,751 | 5/1994 | Wittler | 52/238.1 |
| 5,347,778 | 9/1994 | Bray | 52/239 |
| 5,474,402 | 12/1995 | Wu | 52/238.1 X |

*Primary Examiner*—Carl D. Friedman
*Assistant Examiner*—David J. Jersen
*Attorney, Agent, or Firm*—Brumbaugh, Graves, Donohue & Raymond

[57] ABSTRACT

A partition wall comprising a plurality of partition wall units each of which includes two extruded hollow aluminum columns, two extruded hollow aluminum beams, and four plastic joints; a plurality of resilient snap elements; a plurality of holding bars; and a plurality of sets of locking members, characterized in that the joint comprises a vertical portion and a horizontal portion perpendicular to each other, so that the column and the beam are connected to each other by inserting the vertical portion and the horizontal portion into the column and the beam respectively; and in that the wall units are connected by means of grooves and/or tongues provides on the columns and beams, a plurality of holding bars, and a plurality of sets of locking members.

3 Claims, 6 Drawing Sheets

PARTITION WALL

BACKGROUND OF THE INVENTION

1. Field of the Invention

The present invention relates to an improved partition wall, and more specifically, to an improved connecting structure for assembling a partition wall unit and an improved assembling structure between wall units for forming a partition wall.

2. Description of Prior Arts

Various kinds of partition walls are known, and while the basic structures thereof which normally comprise a plurality of columns, a plurality of beams, and a plurality of panels are similar to one another, it is the assembling manner between these components that distinguishes one partition wall from another. However, in all of these conventional assembling structures, in order to assemble the wall units from columns, beams and panels, and/or to assemble a partition wall from a plurality of partition wall units, the use of a relatively large quantity of additional components acting as connectors or fasteners, such as rivets, bolts, screws, and pins, and/or the use of a certain degree of mechanical processing, such as welding, are usually required. Consequently, processing such as drilling or the like is inevitably required to be performed on each of the columns, beams, or panels after each component is integrally formed, resulting an increased manufacturing cost. In addition, such connectors and fasteners usually have to be locked in place in a specific order during the assembling of the partition wall, so that it usually takes considerable time to complete the assembling and hence the dismantling procedures. Moreover, the control of the assembling accuracy is poor.

The object of the present invention is therefore to provide a quick assembling partition wall in which the components thereof can be assembled immediately after they are formed without requiring any post mechanical processing, thereby reducing the manufacturing cost, and since no aforementioned additional connectors or fasteners are needed, both the assembling and dismantling procedures can be performed easily and quickly, while the strength of the assembly is still maintained.

SUMMARY OF THE INVENTION

According to the present invention, a partition wall comprising a plurality of partition wall units, a plurality of panels; a plurality of resilient snap elements; a plurality of holding bars; and a plurality of sets of locking members of which each set includes a locking tube, two locking plates, and two screws is provided. Each partition wall unit includes two extruded hollow aluminum columns each having a connecting surface through which two units can be connected in the horizontal direction; two extruded hollow aluminum beams each having a connecting surface through which two units can be connected in the vertical direction; and four plastic joints for connecting the columns and the beams to each other. The plastic joint comprises a vertical hollow portion and a horizontal hollow portion perpendicular to each other in a L shape. The outer periphery profile of the cross section of the vertical portion matches with the inner periphery profile of the cross section of the hollow column. The horizontal portion comprises a main body, a connecting end face, a locking portion having a transverse semi-circular groove, an expanding portion slightly projecting beyond both sides of the main body, and a locking slot between the locking portion and the expanding portion on each side of the horizontal portion, and the outer periphery profile of the cross section of the main body matches with the inner periphery profile of the cross section of the hollow beam. The column and the beam are connected to each other by inserting the vertical portion and the main body of the horizontal portion into the column and the beam respectively. The connecting surface of the column is provided with a groove and a tongue spaced from each other and parallelly extending through the entire longitudinal length of the column, so that the partition wall units are connected in the horizontal direction by attaching respective columns of two units through the engagement of the groove and the tongue of the column of one unit with the complementary tongue and groove of the column of another unit. Each of the two side surfaces of the column is provided with a first channel and a second channel spaced from each other and parallelly extending through the entire longitudinal length of the column, in which the first channel is designed to receive a hanging rack therein, and the second channel is designed to receive resilient snap elements which connect the panels to columns and hence to the partition wall units. The connecting surface of the beam is provided with two grooves or two tongues spaced from each other and parallelly extending through the entire longitudinal length of the beam, so that the partition wall units are connected in the vertical direction by attaching respective beams of two units through the engagement of the grooves or the tongues of the beam of one unit with the complementary tongues or grooves of the beam of another unit. The holding bar is made of hard plastics in a substantially ∩-shaped cross section, and has a length substantially equal to the longitudinal length of the column or the beam. The inner periphery profile of the cross section of the concave holding bar matches with the outer periphery profile of the cross section of the attached flanges of two columns or two beams of the two wall units to be assembled, so that the connecting surfaces of the two columns or two beams can be tightly engaged with each other by pressing the holding bars to firmly encase the attached flanges on opposite sides. The locking tube of the locking member is dimensioned to be inserted into a through hole formed by two semi-circular grooves of the horizontal portions of two attached plastic joints, and the thickness of the locking plate is equal to the difference in transverse width between the expanding portion and the locking portion of the horizontal portion of the plastic joint on each side, while the width of the locking plate is designed to just allow each of the projections at both ends of the locking plate to be inserted into the corresponding locking slot between the expanding portion and the locking portion on each of two attached plastic joints, so that two attached plastic joints and hence two partition wall units are firmly connected by tightening the screws passing through the locking plates and the locking tube from both sides.

According to the present invention, preferably, the plastic joint employed to connect the column and the beam to each other is made of Nylon 66 added with glass fibers, and is formed integrally by a injection molding process.

According to the present invention, preferably, the vertical hollow portion of the joint is divided into a plurality of parts by slits extending through the entire length thereof, and the dimension of the outer periphery of the cross section of the vertical portion is made slightly larger than that of the inner periphery of the cross section of the column, and the main body of the horizontal hollow portion of the joint is divided into a plurality of pans by slits extending through the length of the main body, and the dimension of the outer periphery of the cross section of the main body of the horizontal portion is made slightly larger than that of the inner periphery of the cross section of the beam, so that the vertical portion and the horizontal portion of the plastic joint are easily pressed into the hollow column and the hollow beam respectively due to a certain degree of elasticity resulted from the provision of the slits, and tight fits between the vertical portion of the joint and the column and between the horizontal portion of the joint and the beam are achieved by the restoring force of such elasticity.

BRIEF DESCRIPTION OF THE DRAWINGS

The characteristics, advantages, and merits of the present invention will be more clearly understood from the following description of a preferred embodiment with reference to the accompanying drawings, in which.

DESCRIPTION OF THE PREFERRED EMBODIMENT

Figure 1:
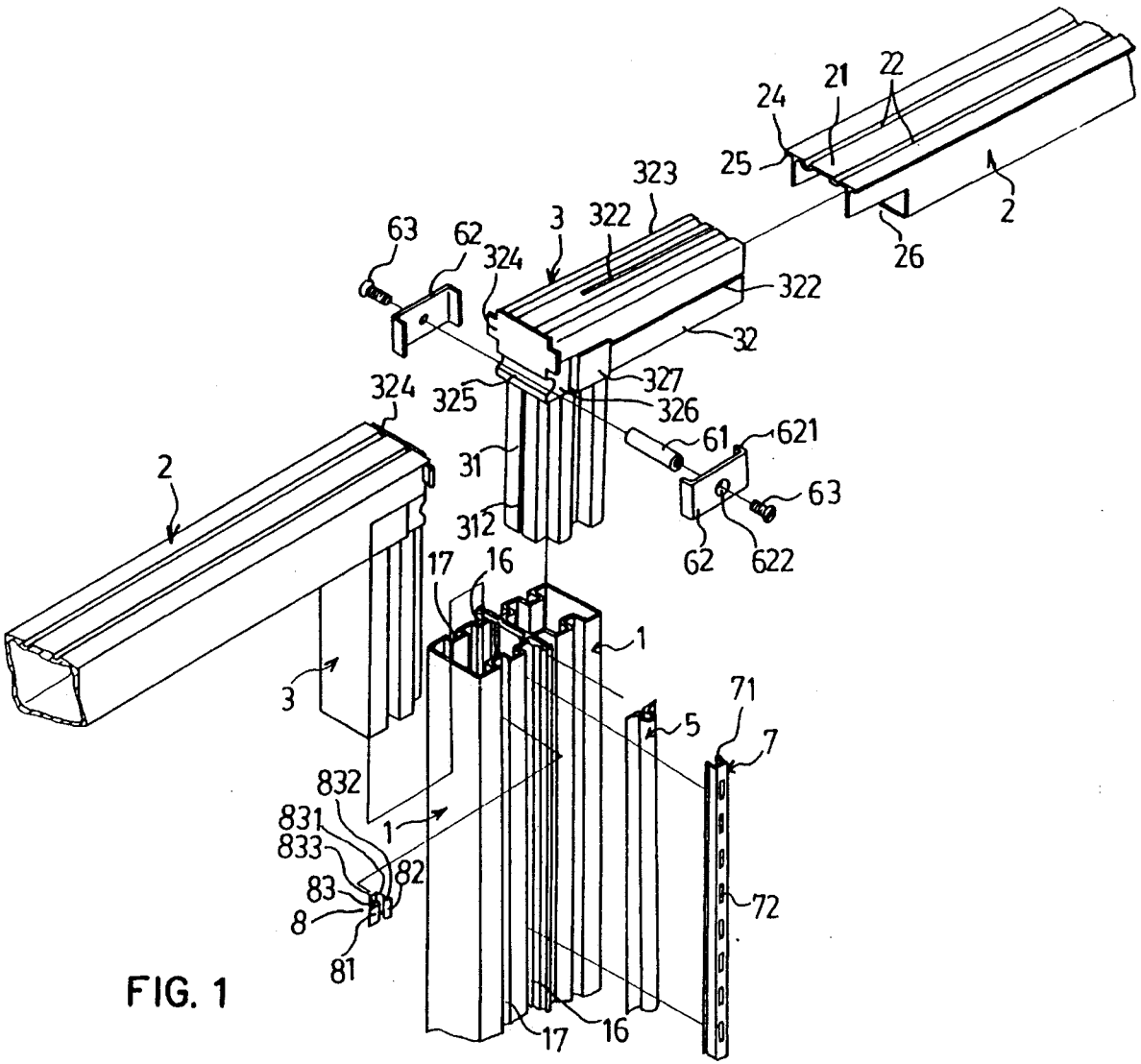
FIG. 1 is a partially exploded perspective view showing the components of a partition wall of a preferred embodiment according to the present invention.
Figure 2:
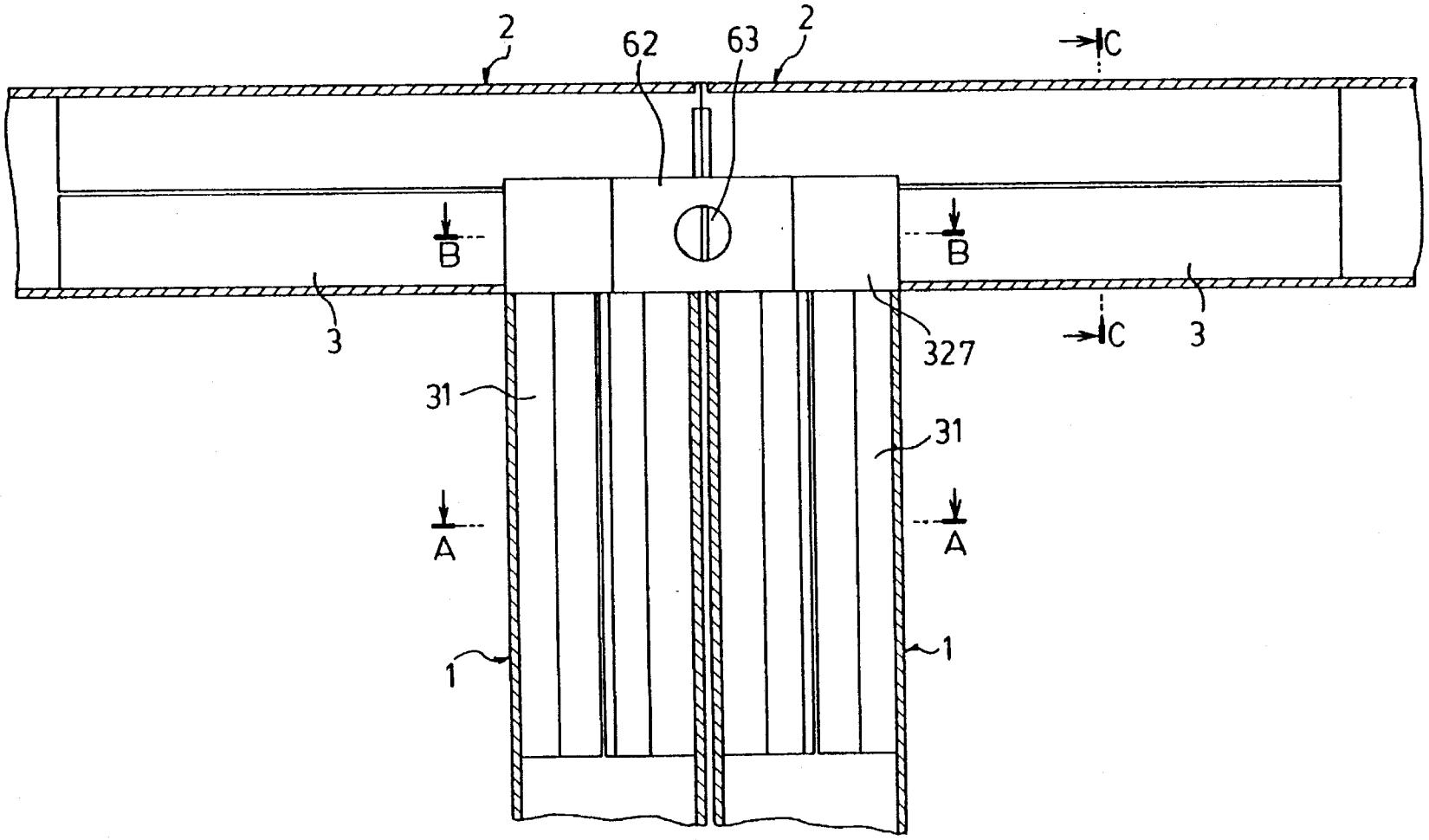
FIG. 2 is a front sectional view partially showing the assembled structure of the partition wall of the preferred embodiment of FIG. 1 according to the present invention.
Figure 3:
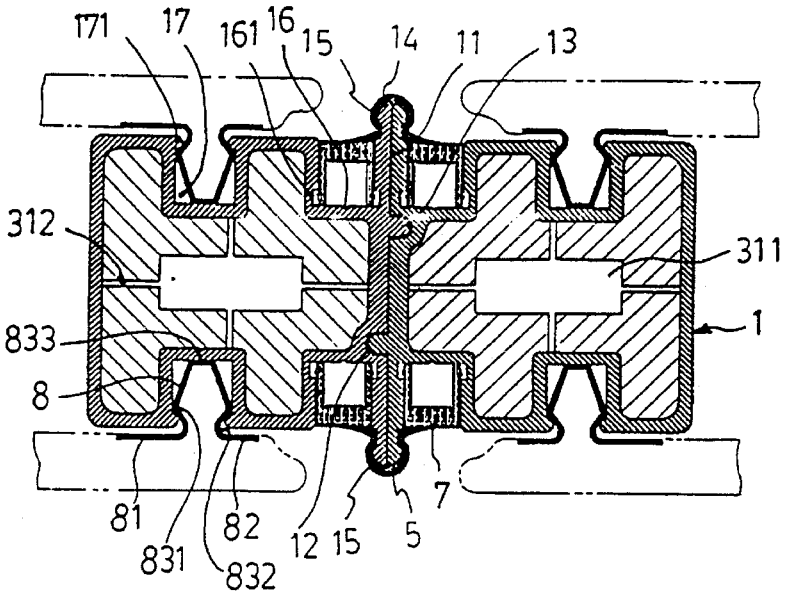
FIG. 3 is a cross sectional view along the line A—A in FIG. 2.
Figure 4:
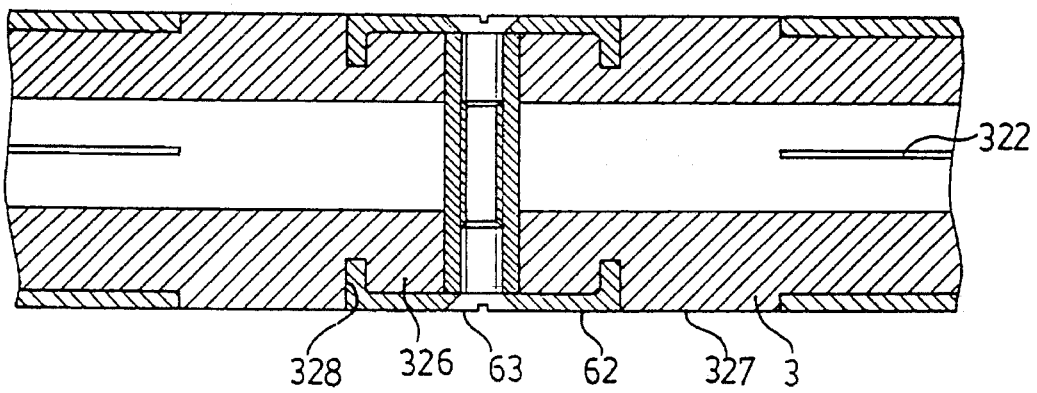
FIG. 4 is a cross sectional view along the line B—B in FIG. 2.
Figure 5:
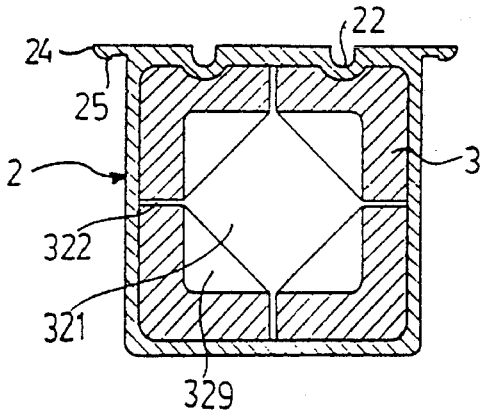
FIG. 5 is a cross sectional view along the line C—C in FIG. 2.

Referring to FIG. 1, a partition wall according to a preferred embodiment of the present invention comprises a plurality of partition wall units of which each is formed by assembling two extruded hollow aluminum columns 1, two extruded hollow aluminum beams 2, and four plastic joints 3 each connecting a column and a beam to each other. The connection between two partition wall units in the horizontal direction is effected through the engagement of two columns 1 of respective units, two holding bars 5, and a locking assembly a locking tube 61, two locking plates 62, and two screws 63, while in the vertical direction, it can be achieved by engaging two beams 2 of respective units and two holding bars 5. FIG. 1 is a partially exploded perspective view showing the above components, and FIG. 2 is a front sectional view partially showing the assembled structure. Although FIGS. 1 and 2 only show part of the connecting structure of the partition wall according to the present invention, it is apparent for those skilled in the art that the other parts are substantially the same. FIGS. 3 to 5 are sectional views showing details of the connecting structure at different portions.

Referring to FIGS. 1 and 3, the column 1 is a typical extruded hollow aluminum frame with a cross sectional shape as best shown in FIG. 3. The column 1 has a connecting surface 11 on which a groove 12 and a tongue 13 spaced from each other and parallelly extending through the entire longitudinal length of the column 1 are provided. In the assembling of the partition wall units of the preferred embodiment according to the present invention, the units are connected in such a way that the groove 12 and the tongue 13 of the column 1 of one unit are engaged with the complementary tongue 13 and the complementary groove 12 of the column 1 of another unit, respectively, which will be described in greater detail hereinafter. The two longitudinal edges of the connecting surface 11 of the column 1 extend respectively beyond the two side surfaces of the column 1 which are perpendicular to the connecting surface 11 to form end flanges 14. Each end flange 14 is provided with an arcuate projection 15 projecting in the direction opposite to the connecting surface 11. Each of the two side surfaces perpendicular to the connecting surface 11 of the column 1 is provided with a first channel 16 and a second channel 17 spaced from each other and parallelly extending through the entire longitudinal length of the column 1. The first channel 16 which is closer to the connecting surface 11 is designed to receive a hanging rack 7 therein. The front face of the hanging rack 7 is provided with a row of hanging holes 72 continuously distributed along the entire longitudinal length thereof for hanging desired furnitures (not shown). Both sides of the bottom of the first channel 16 are provided with locking recesses 161 extending through the entire length of the column 1. When the hanging rack 7 is inserted into the first channel 16, a sideward projection 71 along the edge of each side surface of the hanging rack 7 is caught within the recess 161 on each side of the first channel 16, thereby fixing the hanging rack 7 within the first channel 16. If necessary, the hanging rack 7 can be spot welded to the column 1 at the upper and lower ends thereof, and/or secured to the column 1 with several screws in the longitudinal direction to increase the strength. The second channel 17 remote from the connecting surface 11 is designed to receive a plurality of resilient snap elements 8 which connect panels 4 to the columns 1. Projections 171 projecting toward each other are formed on both sides of the entrance portion of the second channel 17 to engage with the concave portions 832 at both sides of the snap element 8 respectively. The connection between the wall units and the panels 4 will be described in greater detail hereinafter.

The cross sectional shape of the beam 2 is similar to that of the column 1 except that the connecting surface 21 of the beam 2 is provided with two grooves 22 (or two tongues) thereon, and two side surfaces perpendicular to the connecting surface 21 are flat without any channels. The two longitudinal edges of the connecting surface 21 of the beam 2 extend respectively beyond the two side surfaces perpendicular to the connecting surface 21 to form end flanges 24. Each end flange 24 is provided with an arcuate projection 25 projecting in the direction opposite to the connecting surface 21. In addition, cutouts 26 are formed at both longitudinal ends of the beam 2 to abut against an expanding portion 327 of a plastic joint 3 as described hereinafter.

The plastic joint 3 employed to connect the column 1 and the beam 2 to each other is made of Nylon 66 added with glass fibers, and is formed integrally by an injection molding process. The substantially L-shaped plastic joint 3 comprises a vertical portion 31 and a horizontal portion 32 perpendicular to each other which can be inserted into the extruded hollow aluminum column 1 and beam 2 respectively, thereby connecting the column 1 and beam 2 to each other to form a partition wall unit. It can be seen from FIG. 3 that the vertical portion 31 is divided into four parts by a hollow portion 311 and four slits 312 extending through the entire length thereof and the cross section thereof has an outer periphery profile adapted to match with the inner periphery profile of the cross section of the column 1. Preferably, in order to achieve a tight fit between the vertical portion 31 of the plastic joint 3 and the column 1, the dimension of the outer periphery of the cross section of the vertical portion 31 is made slightly larger than that of the cross section of the inner periphery of the column 1. In this case, since the four-part vertical portion 31 has a certain degree of elasticity due to the provision of the four slits 312, the vertical portion 31 of the plastic joint 3 can be pressed into the hollow portion of the column 1 without any difficulties, and after the vertical portion 31 is completely pressed into the column 1, a tight fit between the vertical portion 31 and the column 1 is achieved by the restoring force of such elasticity.

As shown in FIGS. 1 and 5, the horizontal portion 32 with a hollow portion 321 comprises a main body 323, a connecting end face 324, a locking portion 326 having a transverse semi-circular groove 325, an expanding portion 327 slightly projecting beyond both sides of the main body 323, and a locking slot 328 between the locking portion 326 and the expanding portion 327 on each side of the horizontal portion 32. A portion of the main body 323 from the end of the horizontal portion 32 to the expanding portion 327 is divided into four parts by the hollow portion 321 and four slits extending from the end of the horizontal portion 32 to the expanding portion 327. As shown in FIG. 5, the outer periphery profile of the cross section of the main body 323 is designed to match with the inner periphery profile of the cross section of the beam 2. Preferably, the dimension of the outer periphery of the cross section of the main body 323 is made slightly larger than that of the inner periphery of the cross section of the beam 2 in order to achieve a tight fit between the horizontal portion 32 of the plastic joint 3 and the beam 2. As described above for the vertical portion 31, since the four-part portion of the main body 323 has a certain degree of elasticity due to the provision of the four slits 322, the main body 323 of the horizontal portion 32 can be pressed into the hollow portion of the beam 2 without any difficulties, and after the main body 323 of the horizontal portion 32 is pressed into the beam 2, a tight fit between the main body 323 and the beam 2 is achieved by the restoring force of such elasticity. Ribs 329 are provided in the interior of the main body 323 to increase the strength thereof. During the connection of the column 1 and the beam 2 to each other, the horizontal portion 32 is pressed into the beam 2 until the rear edge of the cutout 26 of the beam 2 abuts against the expanding portion 327 of the horizontal portion 32, while the front edge of the beam 2 abuts against the back side of the slightly projecting upper edge of the connecting end face 324 of the horizontal portion 32, as shown in FIG. 2.

After a partition wall unit is assembled by connecting two columns 1 and two beams 2 with four plastic joints 3, panels 4 are mounted onto the unit through a plurality of resilient snap elements 8. The cross sectional shape of the resilient snap element 8 is shown in FIG. 3. The snap element 8 comprises legs 81 and 82 with different widths, which can be inserted in order into the hollow panel 4 easily through the opening provided on the back surface of the panel 4. The main body 83 of the snap element 8 has a widest portion 831, which on the one hand converges toward the legs 81 and 82 to connect therewith through the concave portions 832, and on the other hand converges in the opposite direction to form a flat top 833. When the panel 4 with the snap element 8 (usually four snap elements for one panel) locked in place is to be mounted onto the partition wall unit, although the width of the widest portion 831 of the snap element 8 is larger than the distance between the projections 171 at the entrance portion of the second channel 17 of the column 1, by the guidance of the converging portion and the elasticity of the snap element 8, the main body 83 of the snap element 8 can be easily pressed into the second channel 17 of the column 1 until the flat top 833 of the snap element 8 abuts against the bottom of the second channel 17 of the column 1, while the projections 171 at the entrance portion of the second channel 17 just engage with the concave portions 832 behind the widest portion 831 of the snap element 8. The snap element 8 is prevented from escaping the second channel 17 by such engagement and the restoring force due to the elasticity of the snap element 8, thereby ensuring the connection between the panel 4 and the partition wall unit.

As described above, according to the assembling structure of the preferred embodiment of the present invention, a partition wall unit can be assembled readily and accurately by connecting columns 1 and beams 2 with plastic joints 3, without employing any other connectors or fasteners such as screws or the like. Columns 1 and beams 2 can be used immediately after extruded, while the one-piece plastic joints can be used immediately after injection molded. No further drilling or machining is necessary, and hence the production cost is greatly reduced. Moreover, both the connecting of columns 1 to beams 2 through plastic joints 3 and the assembling of panels 4 onto the columns 1 of the wall units through the resilient snap element 8 are much easier and more convenient than the assembling procedures of conventional partition walls. Especially, the assembling of the panels 4 onto the columns 1 is not restricted to limited locations defined by holes of fixed positions as in the conventional partition walls, since the snap elements 8 can be locked in any positions in the longitudinal direction of the columns 1.

The connecting structure to effect the assembling of partition wall units into a partition wall will now be described in detail. As shown in FIGS. 1 and 3, the primary connection of two partition wall units in the horizontal direction is achieved by engaging the groove 12 and the tongue 13 on a column 1 of a partition wall unit with the complementary tongue 13 and groove 12 on a column 1 of another partition wall unit respectively. Since both the groove 12 and the tongue 13 extend longitudinally through the entire length of the column 1, the connecting surfaces 11 of the respective columns 1 can be easily and quickly locked in place by the engagement of complementary grooves 12 and tongues 13, and are thus closely attached with each other with the end flanges 14 and the projections 15 thereof also symmetrically and closely attached with each other, as shown in FIG. 3. Such kind of engagement increases the stability of the attachment. The engagement of the complementary grooves 12 and tongues 13 makes the columns 1 and hence two partition wall units closely attached with each other. Also, the two plastic joints 3 at the top and bottom ends of the column 1 of one partition wall unit are closely attached with the two plastic joints 3 at the top and bottom ends of the column 1 of the other partition wall unit through the end faces 324 thereof, respectively. Due to such attachment, the two semi-circular transverse grooves 325 on the respective plastic joints 3 form a circular transverse through hole 325*a*. Now, the two partition wall units can be further connected by means of two holding bars 5 and two sets of locking members 6.

According to the preferred embodiment of the present invention, two holding bars 5 and two sets of locking assemblies 6 of which each set includes a locking tube 61, two locking plates 62, and two screws 63 are used as the the connecting means for two partition wall units. The holding bars 5 having a substantially ∩-shaped cross section is made of hard plastics, and has a length substantially equal to the longitudinal length of the column 1. As shown in FIG. 3, the inner profile of the cross section of the concave holding bar 5 matches with the outer profile of the cross section of the attached flanges 14 and projections 15 of the two columns 1, so that two columns 1 can be tightly connected with each other by pressing the holding bar 5 to encase the attached flanges 14 and projections 15 on each side. When the holding bar 5 is pressed in place, the two slightly softer side strips of the holding bar 5 cover the hanging holes of the respective hanging racks 7 inserted into the first channels 16 of the two engaged columns 1. Such arrangement makes the assembled partition wall more aesthetic. Since the side strips of the holding bar 5 are relatively thinner and softer, so that the objects to be hanged can directly pierce through the side strips into the hanging holes of the hanging rack 7.

On the other hand, the locking member 6 is employed to connect the two partition wall units by locking two plastic joints 3. First, the locking tube 61 having an outer diameter substantially equal to the inner diameter of the transverse through hole 325*a* and a length substantially equal to the transverse width of the locking portion 326 of the horizontal portion 32 of the plastic joint 3 is inserted into the through hole 325*a*. The locking tube 61 has a threaded central hole 611 extending through the entire length thereof to engage with the screws 63 from both ends after the locking plates 62 are positioned in place on both sides of two attached plastic joints 3. As shown in FIG. 4, the thickness of the locking plate 62 is equal to the difference in transverse width between the expanding portion 327 and the locking portion 326 of the horizontal portion 32 of the plastic joint 3 on one side, while the width of the locking plate 62 is designed to just allow each of the projections 621 at both ends of the locking plate 62 to be inserted into the corresponding locking slot 328 between the expanding portion 327 and the locking portion 326 on the respective plastic joints. A central hole 622 through which the screw is inserted is provided on the locking plate 62. By tightening the screws 63 from both sides, the plastic joints 3 of two partition wall units can be firmly connected by means of the locking member 6, thereby increasing the strength of connection of the two partition wall units achieved by means of the holding bars 5.

According to the assembling structure described above, a plurality of partition wall units can be assembled in the horizontal direction to become a partition wall according to the present invention. If desired, a plurality of partition wall units can be assembled in the vertical direction by connecting the beams of two units in substantially the same way.

Figure 6:
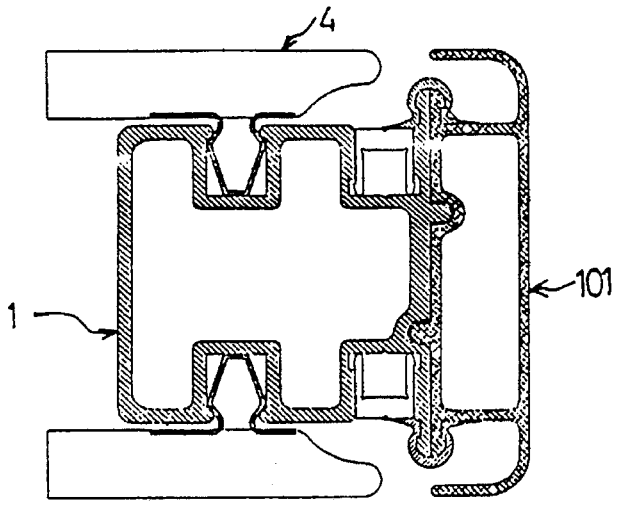
FIG. 6 is a cross sectional view schematically showing the connection between a column of a partition wall unit and a wall ending column according to a preferred embodiment of the present invention.
Figure 7:
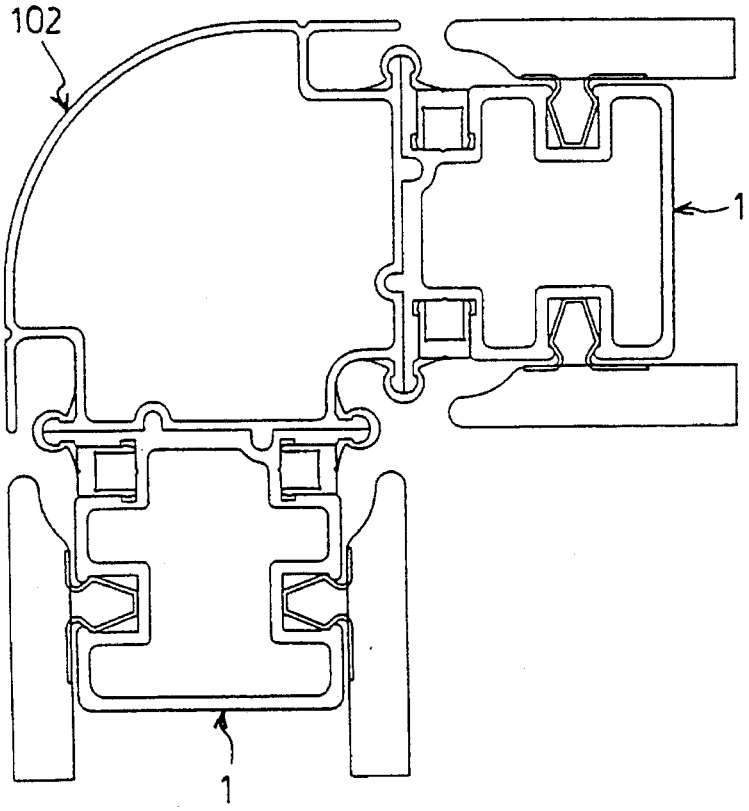
FIG. 7 is a schematic cross sectional view partially showing the connection between columns of two partition wall units through a corner column to form a L-shaped partition wall according to a preferred embodiment of the present invention.
Figure 8:
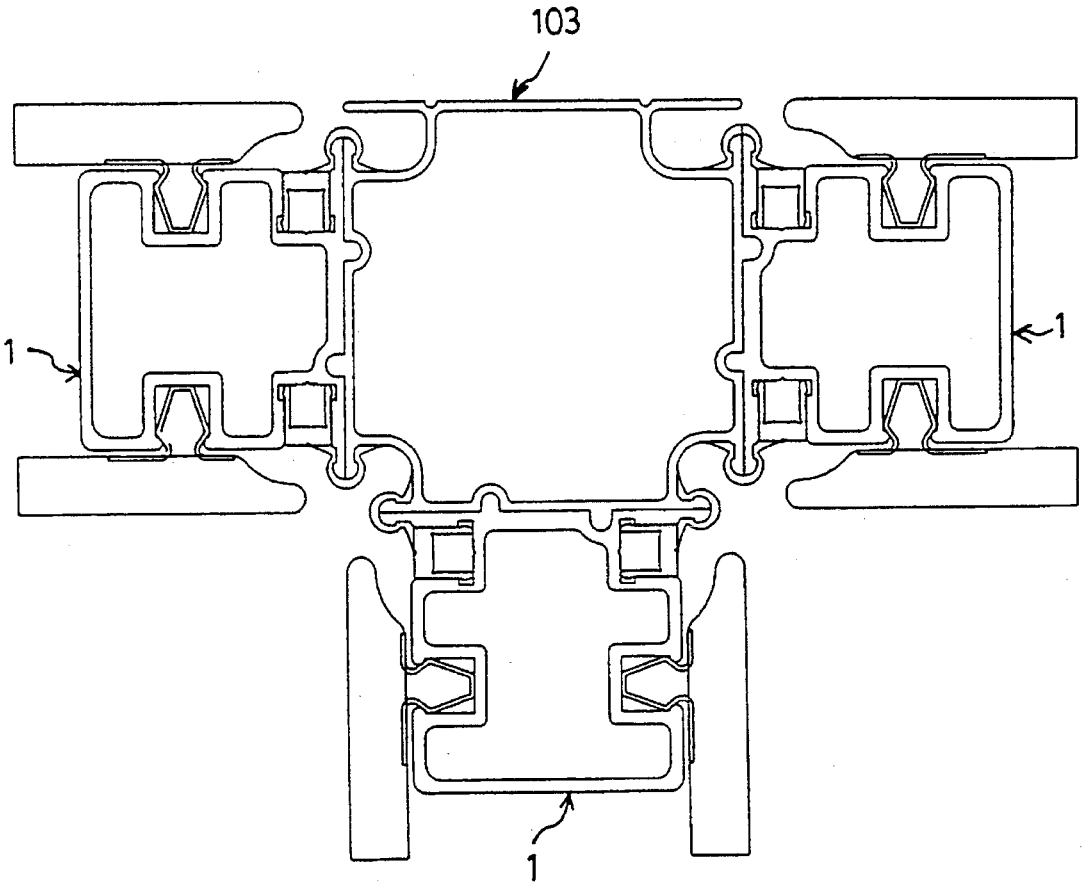
FIG. 8 is a schematic cross sectional view partially showing the connection between columns of three partition wall units through a three-way column to form a T-shaped partition wall according to a preferred embodiment of the present invention.
Figure 9:
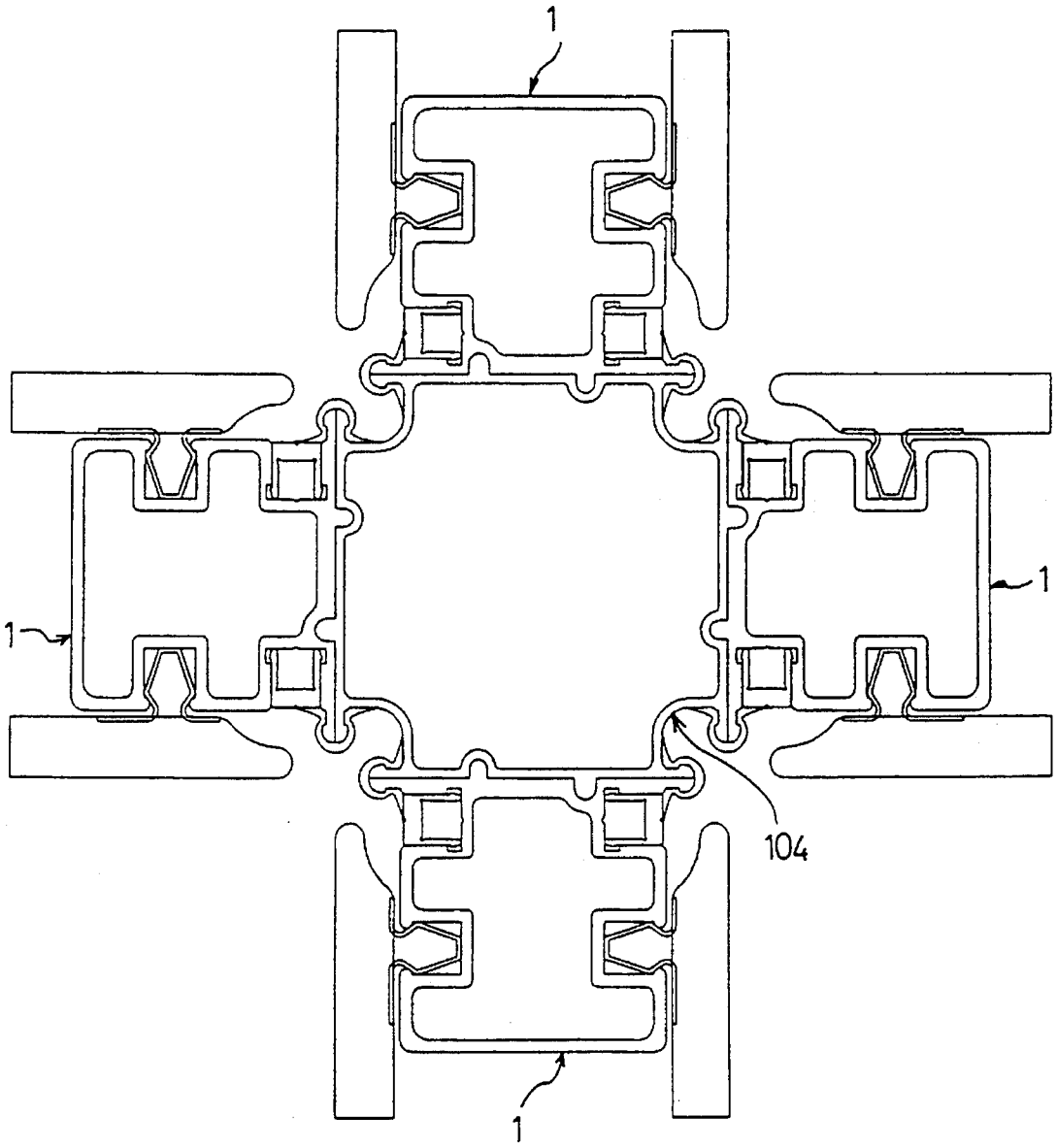
FIG. 9 is a schematic cross sectional view partially showing the connection between columns of four partition wall units through a four-way column to form a X-shaped partition wall according to a preferred embodiment of the present invention.

FIG. 6 is a cross sectional view schematically showing the connection between a column 1 of a partition wall unit and a wall ending column 101 according to a preferred embodiment of the present invention. FIG. 7 is a schematic cross sectional view partially showing the connection between columns 1 of two partition wall units through a corner column 102 to form a L-shaped portion wall. FIG. 8 is a schematic cross sectional view partially showing the connection between columns 1 of three partition wall units through a three-way column 103 to form a T-shaped partition wall. FIG. 9 is a schematic cross sectional view partially showing the connection between columns 1 of four partition wall units through a four-way column 104 to form a X-shaped partition wall. As shown in FIGS. 6 to 9, the column 1 of a partition wall unit is connected to the wall ending column 101, the corner column 102, the three-way column 103, or the four-way column 104 in substantially the same manner as to the column of another partition wall unit. Complementary grooves and tongues are provided on all of the connecting surfaces, and holding bars are provided to encase the symmetrically attached flanges and projections.

As described above, according to the preferred embodiment of the present invention, columns 1 or beams 2 of partition wall units to be assembled can be quickly and accurately positioned in place to attach with each other by the engagement of the complementary grooves and/or tongues provided on the columns 1 and/or beams 2, and then the partition wall units can be tightly connected by means of the holding bars 5 and the locking assemblies.

Although a preferred embodiment of the present invention has been described in detail, it should be understood that the present invention is not limited thereto, and various modifications and changes can be made without departing from the spirit and scope of the invention defined in the accompanying claims.

What is claimed is:

1. A partition wall, comprising:

a plurality of partition wall units each of which includes:

two extruded hollow aluminum columns each having a connecting surface through which two units are connected in the horizontal direction and two side surfaces perpendicular to said connecting surface, in which two longitudinal edges of said connecting surface extend beyond said side surfaces respectively, each forming an end flange having an arcuate projection projecting in the direction opposite to said connecting surface;

two extruded hollow aluminum beams each having a connecting surface through which two units are connected in the vertical direction and two side surfaces perpendicular to said connecting surface, in which two longitudinal edges of said connecting surface extend beyond said side surfaces respectively, each forming an end flange having an arcuate projection projecting in the direction opposite to said connecting surface; and four plastic joints for connecting the columns and the beams to each other;

a plurality of panels;

a plurality of resilient snap elements;

a plurality of holding bars; and a plurality of sets of locking assemblies of which each set includes a locking tube, two locking plates, and two screws, characterized in that:

said plastic joint comprises a vertical hollow portion and a horizontal hollow portion perpendicular to each other in a L shape, in which the outer periphery profile of the cross section of said vertical portion matches with the inner periphery profile of the cross section of the hollow column, while said horizontal portion comprises a main body, a connecting end face, a locking portion having a transverse semi-circular groove, an expanding portion slightly projecting beyond both sides of the main body, and a locking slot between said locking portion and said expanding portion on each side of said horizontal portion, and the outer periphery profile of the cross section of said main body of said horizontal portion matches with the inner periphery profile of the cross section of the hollow beam, so that the column and the beam are connected to each other by inserting said vertical portion and said main body of said horizontal portion into the column and the beam respectively;

said connecting surface of the column is provided with a groove and a tongue spaced from each other and parallelly extending through the entire longitudinal length of the column, so that the partition wall units are connected in the horizontal direction by attaching respective columns of two units through the engagement of said groove and said tongue of the column of one unit with complementary said tongue and said groove of the column of another unit, and each of the two side surfaces of the column is provided with a first channel and a second channel spaced from each other and parallelly extending through the entire longitudinal length of the column, in which said first channel closer to said connecting surface is designed to receive a hanging rack therein, and said second channel remote from said connecting surface is designed to receive said resilient snap elements which connect said panels to columns and hence to the partition wall units;

said connecting surface of the beam is provided with two grooves or two tongue spaced from each other and parallelly extending through the entire longitudinal length of the beam, so that the partition wall units are connected in the vertical direction by attaching respective beams of two units through the engagement of said grooves or said tongues of the beam of one unit with complementary said tongues or said grooves of the beam of another unit;

said holding bar is made of hard plastics in a substantially ∩-shaped cross section, and has a length substantially equal to the longitudinal length of the column or the beam, and the inner periphery profile of the cross section of the concave holding bar matches with the outer periphery profile of the cross section of the attached flanges and projections of two columns or two beams of the two wall units to be assembled, so that said connecting surfaces of said two columns or two beams are tightly engaged with each other by pressing said holding bars to firmly encase the attached flanges and projections on opposite sides; and said locking tube of said locking assembly is dimensioned to be inserted into a through hole formed by two said semi-circular grooves of the horizontal portions of two attached plastic joints, and the thickness of said locking plate is equal to the difference in transverse width between said expanding portion and said locking portion of the horizontal portion of the plastic joint on each side, while the width of said locking plate is designed to just allow each of the projections at both ends of said locking plate to be inserted into corresponding said locking slot between said expanding portion and said locking portion on each of two attached plastic joints, so that two attached plastic joints and hence two partition wall units are firmly connected by tightening said screws passing through said locking plates and said locking tube from both sides.

2. A partition wall according to claim 1, wherein said plastic joint employed to connect the column and the beam to each other is made of Nylon 66 added with glass fibers, and is formed integrally by a injection molding process.

3. A partition wall according to claim 1 or 2, wherein said vertical hollow portion of the joint is divided into a plurality of parts by slits extending through the entire length thereof, and the dimension of the outer periphery of the cross section of said vertical portion is made slightly larger than that of the inner periphery of the cross section of the column, while said main body of said horizontal hollow portion of the joint is divided into a plurality of parts by slits extending through the length of said main body, and the dimension of the outer periphery of the cross section of said main body of said horizontal portion is made slightly larger than that of the inner periphery of the cross section of the beam, so that said vertical portion and said horizontal portion of the plastic joint are easily pressed into the hollow column and the hollow beam respectively due a certain degree of elasticity resulted from the provision of the slits, and tight fits between said vertical portion of the joint and the column and between said horizontal portion of the joint and the beam are achieved by the restoring force of such elasticity.

* * * * *